US006453217B1

(12) United States Patent
Takita

(10) Patent No.: US 6,453,217 B1
(45) Date of Patent: Sep. 17, 2002

(54) FREQUENCY SWITCHING METHOD BY MICROCOMPUTER AND FREQUENCY SWITCHING DEVICE

(75) Inventor: Hiroki Takita, Tokyo (JP)

(73) Assignees: Mitsubishi Electric Semiconductor System Corporation, Tokyo (JP); Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/347,273

(22) Filed: Jul. 6, 1999

(30) Foreign Application Priority Data

Jan. 29, 1999 (JP) ..... 11-022988

(51) Int. Cl.[7] ..... G05F 1/00; H05B 41/24
(52) U.S. Cl. ..... 700/297; 315/307
(58) Field of Search ..... 700/297, 12, 14, 700/22, 298, 306, 292, 294; 315/307, DIG. 2, DIG. 4, DIG. 5, DIG. 7, 247, 291; 713/500, 501

(56) References Cited

U.S. PATENT DOCUMENTS 4,538,231 A * 8/1985 Abe et al. ..... 700/298
5,511,209 A * 4/1996 Mensch, Jr. ..... 713/500
6,137,240 A * 10/2000 Bogdan ..... 315/307
6,259,215 B1 * 7/2001 Roman ..... 315/307

FOREIGN PATENT DOCUMENTS

JP 5-211098 8/1993

* cited by examiner

*Primary Examiner*—Leo Picard
*Assistant Examiner*—Steven R. Garland
(74) *Attorney, Agent, or Firm*—Burns, Doane, Swecker & Mathis, LLP

(57) ABSTRACT

A frequency switching method controlled by a microcomputer (74) incorporated in a frequency switching device is capable of halting a timer (81) at a timing at which a pattern of levels of pulse signals supplied from the timer (81) is agreed with a predetermined pattern, of setting a desired frequency to the timer (81), and then of restarting the operation of the timer (81) after a passage of a predetermined time period counted from the above timing in order to generate pulse signals of a desired frequency and outputs them to a pre-driver (73).

10 Claims, 9 Drawing Sheets

FREQUENCY SWITCHING METHOD BY MICROCOMPUTER AND FREQUENCY SWITCHING DEVICE

BACKGROUND OF THE INVENTION

1. Field of the Invention

The present invention relates to a frequency switching method and a frequency switching device. The frequency switching method is executed under the control of a microcomputer. The frequency switching device controls the operation of various types of application devices based on pulse signals. And, more particularly, the present invention relates to a frequency switching method based on the control of a microcomputer and a frequency switching device for supplying pulse signals of a desired frequency to a driver in order to control the operation of each application device.

2. Description of the Related Art

There are devices whose operation are controlled based on pulse signals having a desired frequency. Those devices have been widely used in various application fields. For example, there is a lighting device of an inverter fluorescent lamp as one of examples of those application devices. In order to operate the lighting device of the inverter fluorescent lamp efficiently, it must be required to heat the inverter fluorescent lamp, and then to discharge the inverter fluorescent lamp, and finally to light the inverter fluorescent lamp. For each of the three operations above, it must be required to supply a pulse signal of an optimum frequency. In other words, it must be required to generate and supply an optimum resonance frequency for each of the three operations, the heating operation, the discharging operation, and the lighting operation. In order to achieve this, it is required to oscillate the pulse signal by slightly changing the frequency of the pulse signal during the lighting process for the inverter fluorescent lamp. And it is then required to supply the pulse signal having the optimum frequency to the driver circuit for the inverter fluorescent lamp.

A conventional inverter lighting device of the inverter fluorescent lamp incorporates an analogue circuit to generate a pulse signal of a high frequency of several ten KHz and to supply the generated pulse signal to the inverter fluorescent lamp. There is a CR oscillator as this analogue circuit. The CR oscillator generates the pulse signal of the desired optimum high frequency by changing the values of an internal resistance and a capacitance that are made up of the CR oscillator.

Recently, the lighting device incorporates the driver circuit comprising a microcomputer, and the frequency of a clock signal to be used in the microcomputer is divided into a half dividing ratio (½) of the frequency. Thereby, the driver circuit provides the pulse signal having a high frequency of a half-dividing ratio to the inverter fluorescent lamp.

There is a conventional patent document as a prior art, Japanese Laid-open Publication Number JP-A-5/211098 that has disclosed a conventional inverter lighting circuit.

FIG. 1 is a circuit diagram showing the conventional inverter lighting circuit. In FIG. 1, the reference number 91 designates an AC power source, 92 denotes a DC power circuit, 93 indicates a control circuit, 94 designates a microcomputer incorporated in the control circuit 93. The control circuit 93 inputs pulse signals that are generated by and transferred from the microcomputer 94. The microcomputer 93 switches (or changes) the pulse signal into another pulse signal having a desired frequency by which a switching element 95 consisting of a MOS FET is controlled. The microcomputer 93 then outputs the desired pulse signal to the switching element 95. The reference number 95 designates the switching element consisting of the MOS FET that operates under the control of the pulse signal provided from the control circuit 93. The reference number 96 indicates an inverter fluorescent lamp.

A description will be given of the operation of the conventional inverter lighting circuit shown in FIG. 1.

In the conventional inverter lighting circuit shown in FIG. 1, a dividing ratio of the clock signal used in the microcomputer 94 is switched (or changed). In addition, the lighting operation of the fluorescent lamp 96 is controlled by using the pulse signal of a 50 percent duty that has been obtained by dividing the frequency of the clock signal.

Since the pulse generation method and the control circuit for generating the pulse signals of a desired frequency has the configuration described above, some types of the microcomputers causes following drawbacks.

For example, when the timer value of the timer incorporated in the microcomputer is switched (or changed), namely, when the dividing rate of the clock signal is changed, some types of the microcomputers require the halt of the operation of the timer in order to switch the timer value and then to re-start the operation of the timer. In addition, other types of the microprocessors are automatically reset when a new timer value is written into the timer. The conventional inverter lighting circuits incorporating those microcomputers have a drawback in which an abnormal pulse having a small pulse width (for example, a half or less) that is very smaller than the width of the pulse that being currently oscillated is generated, and the abnormal pulse gives a damage to the switching device (for example, the switching element 95 consisting of the MOS FET shown in FIG. 1), and sometimes breaks the switching device by receiving the abnormal pulse.

Accordingly, in the frequency switching method of generating an optimum frequency of the pulse signal to change an inverter vibration-frequency to be used by the inverter lighting circuit, it must be required to provide the microcomputer capable of switching or changing a newly desired timer value at a following start timing without any changing of the timer value that is currently used.

In the explanation described above, this requirement arises in the conventional inverter lighting circuit. However, the same problem also arises in various kinds of devices whose operations are controlled based on pulse signals of different frequencies.

SUMMARY OF THE INVENTION

Accordingly, an object of the present invention is, with due consideration to the drawbacks of the conventional technique, to provide a frequency switching method and frequency switching device that is capable of switching a current timer value in a timer to a desired timer value based on the timing of the pulse signal of a current frequency. This feature can avoid to damage a driver such as a switching device and can switch the pulse signal of the current frequency to a pulse signal of a desired frequency smoothly.

In accordance with a preferred embodiment of the present invention, a frequency switching method to be executed by a microcomputer has the following steps of: detecting required times signal levels of pulse signals continuously generated by and outputted from a timer incorporated in said microcomputer; halting an operation of said timer, simultaneously outputting a predetermined level of a signal from said microcomputer while the operation of said timer is halted, and setting a desired timer value to said timer within a predetermined time period counted from a detection time of a last pulse signal having a predetermined level in said detected pulse signals when said detection results of the signal levels of the pulse signals is matched to a predetermined pattern; restarting the operation of said timer after said predetermined time period is passed, and setting a level of a first pulse signal, to be outputted firstly at the restart time of said timer, into a predetermined level; and outputting said pulse signal having the predetermined frequency to outside of said microcomputer.

In the frequency switching method as another preferred embodiment of the present invention, the agreement of the matching of said detection results of the signal levels of the pulse signals to said predetermined pattern means that said detection results indicate a H level, a L level, and a H level, in order, and said predetermined time period is a time of a ½ wavelength of said pulse signal, and the level of the signal to be outputted from said microcomputer is the H level while the operation of said timer is halted, and a level of a first pulse signal to be outputted is the L level when said timer is restarted.

In the frequency switching method as another preferred embodiment of the present invention, the agreement of the matching of said detection results of the signal levels of the pulse signals to said predetermined pattern means that said detection results indicate a L level, a H level, and a L level, in order, and said predetermined time period is a time of a ½ wavelength of said pulse signal, and the level of the signal to be outputted from said microcomputer is the L level while the operation of said timer is halted, and a level of a first pulse signal to be outputted firstly is the H level when said timer is restarted.

In the frequency switching method as another preferred embodiment of the present invention, the agreement of the matching of said detection results of the signal levels of the pulse signals to said predetermined pattern means that said detection results indicate a L level, a H level, and a L level, in order, and said predetermined time period is a time of one wavelength of said pulse signal, and the level of the signal to be outputted from said microcomputer during a first half in said one wavelength is the L level while the operation of said timer is halted, and the level of the signal to be outputted from said microcomputer during a latter half in said one wavelength is the H level while the operation of said timer is halted, and a level of a first pulse signal to be outputted firstly is the L level when said timer is restarted.

In the frequency switching method as another preferred embodiment of the present invention, the agreement of the matching of said detection results of the signal levels of the pulse signals to said predetermined pattern means that said detection results indicate a H level, a L level, and a H level, in order, and said predetermined time period is a time of one wavelength of said pulse signal, and the level of the signal to be outputted from said microcomputer during a first half in said one wavelength is the H level while the operation of said timer is halted, and the level of the signal to be outputted from said microcomputer during a latter half in said one wavelength is the L level while the operation of said timer is halted, and a level of a first pulse signal to be outputted firstly is the H level when said timer is restarted.

In the frequency switching method as another preferred embodiment of the present invention, the agreement of the matching of said detection results of the signal levels of the pulse signals to said predetermined pattern means that said detection results indicate a L level and a H level, in order, and said predetermined time period is a time of a ½ wavelength of said pulse signal, and the level of the signal to be outputted from said microcomputer is the H level while the operation of said timer is halted, and a level of a first pulse signal to be outputted is the L level when said timer is restarted.

In the frequency switching method as another preferred embodiment of the present invention, the agreement of the matching of said detection results of the signal levels of the pulse signals to said predetermined pattern means that said detection results indicate a H level and a L level, in order, and said predetermined time period is a time of a ½ wavelength of said pulse signal, and the level of the signal to be outputted from said microcomputer is the L level while the operation of said timer is halted, and a level of a first pulse signal to be outputted firstly is the H level when said timer is restarted.

In the frequency switching method as another preferred embodiment of the present invention, the agreement of the matching of said detection results of the signal levels of the pulse signals to said predetermined pattern means that said detection results indicate a H level and a L level, in order, and said predetermined time period is a time of one wavelength of said pulse signal, and the level of the signal to be outputted from said microcomputer during a first half in said one wavelength is the L level while the operation of said timer is halted, and the level of the signal to be outputted from said microcomputer during a latter half in said one wavelength is the H level while the operation of said timer is halted, and a level of a first pulse signal to be outputted firstly is the L level when said timer is restarted.

In the frequency switching method as another preferred embodiment of the present invention, the agreement of the matching of said detection results of the signal levels of the pulse signals to said predetermined pattern means that said detection results indicate a L level and a H level, in order, and said predetermined time period is a time of one wavelength of said pulse signal, and the level of the signal to be outputted from said microcomputer during a first half in said one wavelength is the H level while the operation of said timer is halted, and the level of the signal to be outputted from said microcomputer during a latter half in said one wavelength is the L level while the operation of said timer is halted, and a level of a first pulse signal to be outputted firstly is the H level when said timer is restarted.

In accordance with a preferred embodiment of the present invention, a frequency switching device has a microcomputer and a driver circuit for controlling a device as a target of control operation. Said microcomputer includes: a memory circuit for storing a control program and control data for controlling operation of said target device; a timer for generating and outputting pulse signals of ½ duty of a desired frequency by changing a timer value; and an input/output port through which said control data and said pulse signals are transferred to said driver circuit. Said driver circuit is connected to said input/output port, and said driver circuit inputs said pulse signals outputted from said microcomputer through said input/output port, and said microcomputer executes said control program capable of performing each of said frequency switching methods according to the present invention described above.

BRIEF DESCRIPTION OF THE DRAWINGS

These and other objects, features, aspects and advantages of the present invention will become more apparent from the following detailed description of the present invention when taken in conjunction with the accompanying drawings, in which.

DESCRIPTION OF THE PREFERRED EMBODIMENTS

Figure 1:
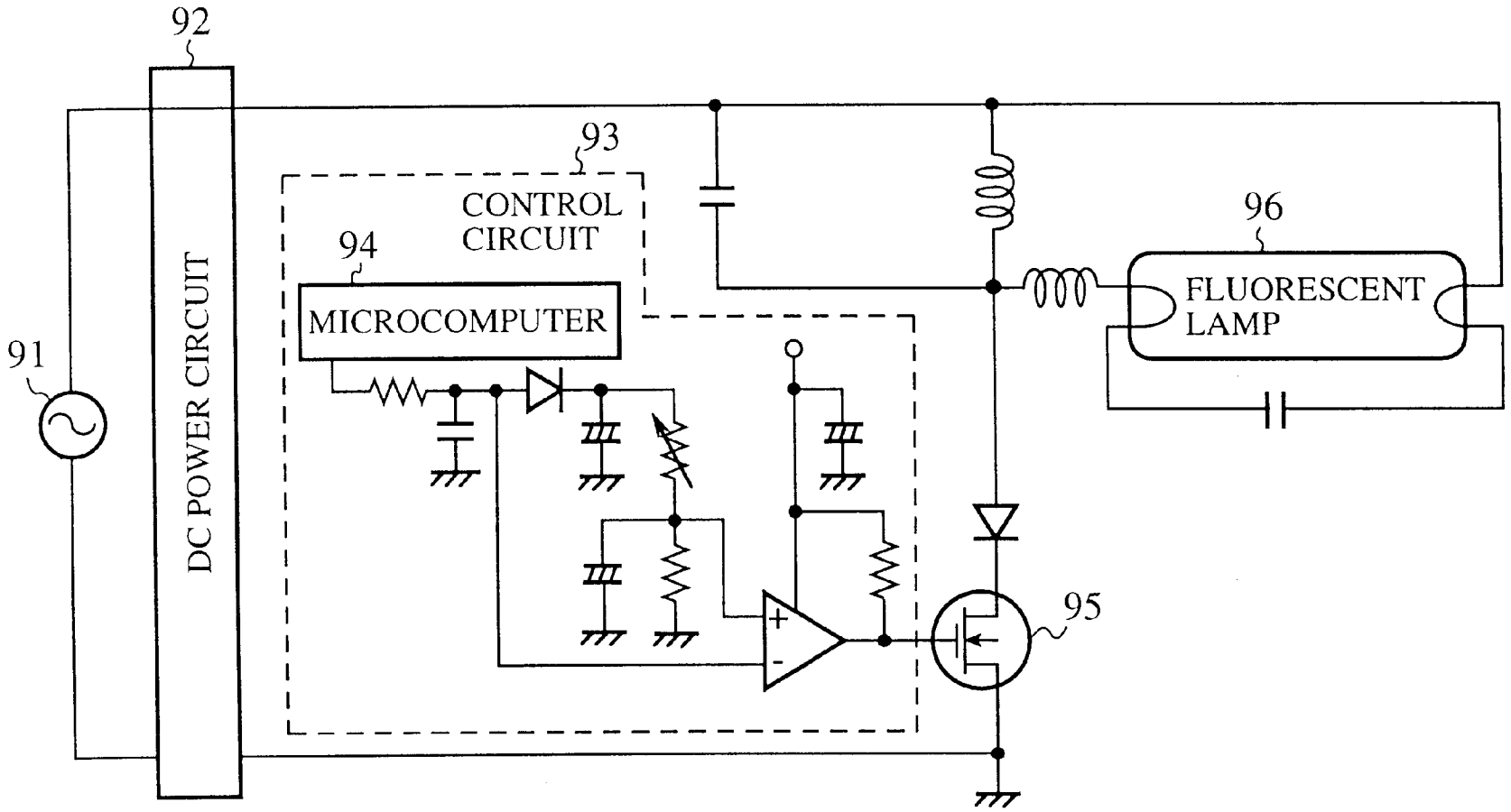
FIG. 1 (PRIOR ART)
FIG. 1 is a circuit diagram showing a conventional inverter lighting circuit.

Other features of this invention will become apparent through the following description of preferred embodiments which are given for illustration of the invention and are not intended to be limiting thereof.

First Embodiment

FIG. 2 to FIG. 7 are flow charts showing the frequency switching methods according to the first to sixth embodiments of the present invention, respectively. FIG. 8 is a circuit diagram showing the configuration of the frequency switching device capable of executing the frequency switching methods of the first to sixth embodiments shown in FIG. 2 to FIG. 7.

The frequency switching device shown in FIG. 8 is a lighting circuit for an inverter fluorescent lamp as one examples of devices to which the frequency switching methods of the present invention are applied. However, the present invention is not limited by this application, for example, it is possible to apply the concept of the present invention to various types of devices that are controlled by switching the frequency of the pulse signal.

In FIG. 8, the reference number 71 designates an AC power source, 72 denotes a DC power circuit, 73 indicates a control circuit as a pre-driver, and 74 designates a microcomputer. The reference number 76 designates an inductance, 77 denotes a capacitor, and 78 indicates an inverter fluorescent lamp. The reference numbers 741 and 742 designate input/output terminals of the microcomputer 74 through which signals of a desired level and pulse signals having a desired frequency are transferred from the microcomputer 74 to the pre-driver 73. In addition, the microcomputer 74 also receives control signals transferred from a remote controller and a control panel by a user through the input/output port 742.

Figure 8:
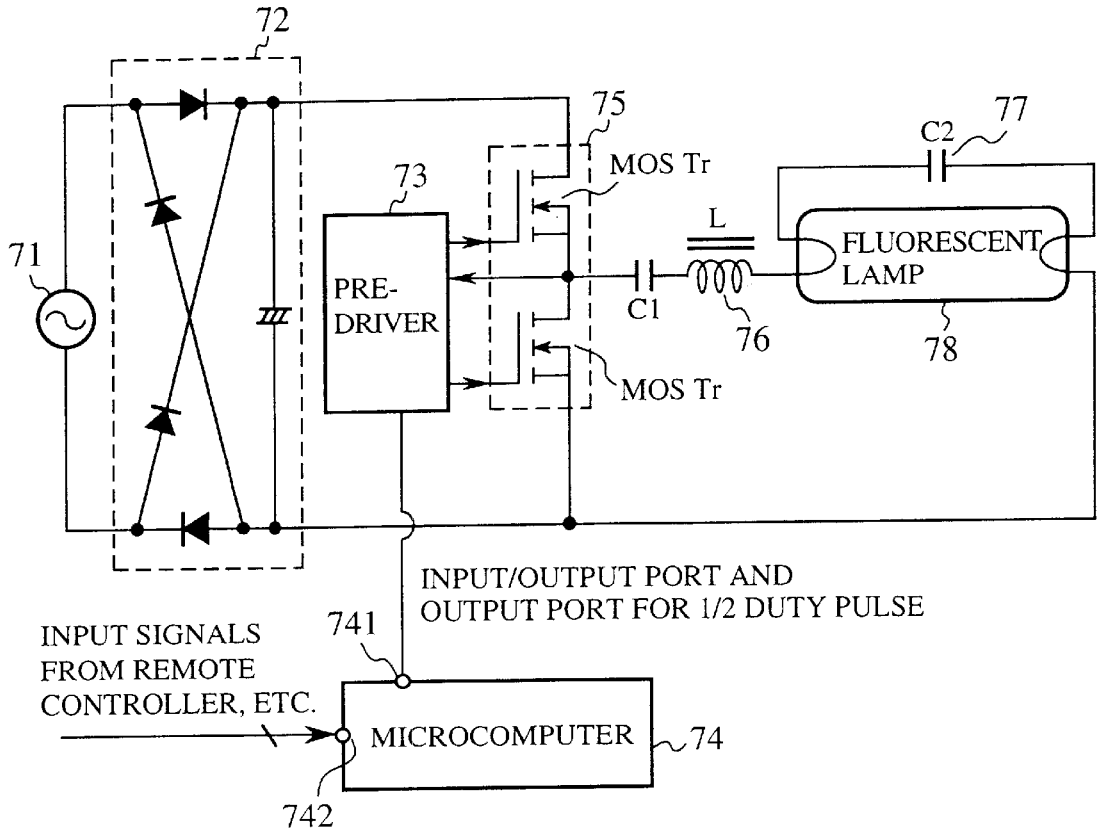
FIG. 8 is a circuit diagram showing the configuration of a frequency switching device capable of performing the frequency switching method by the microcomputer according to the present invention shown in FIG. 2 to FIG. 7.
Figure 9:
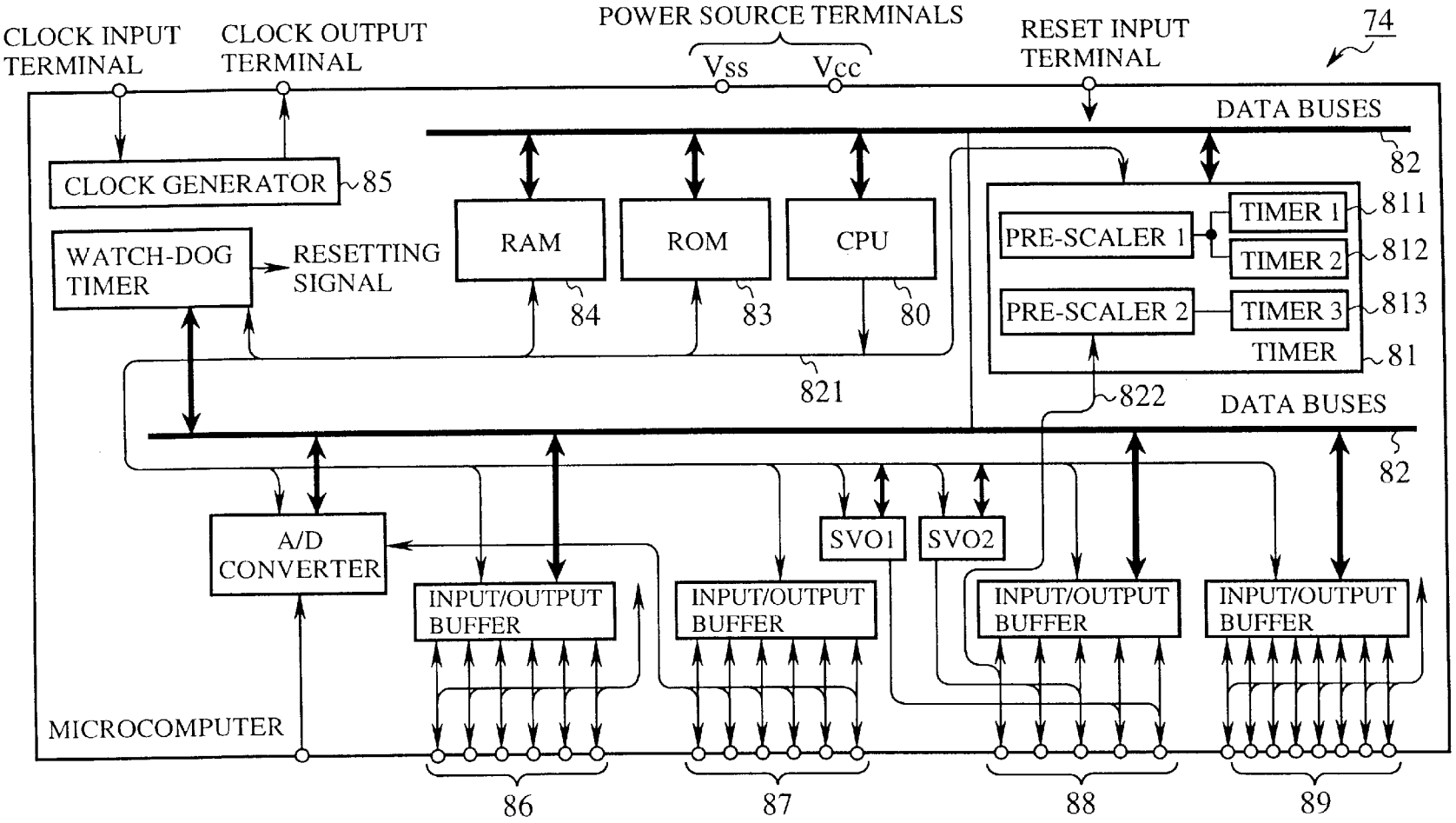
FIG. 9 is a circuit diagram showing an internal configuration of the microcomputer incorporated in the frequency switching device shown in FIG. 8.

FIG. 9 is a diagram showing a detailed configuration of the microcomputer 74 shown in FIG. 8 in the frequency switching device of the present invention. In FIG. 9, the reference number 80 designates a CPU for controlling the operation of the microcomputer 74, 81 denotes a timer for generating and outputting a pulse signal of a ½ duty having a desired frequency. The timer 81 comprises a timer (1) 811, a timer (2) 812, a timer (3) 813, a pre-scaler 1, and a pre-scaler 2. The reference numbers 83 and 84 designate a read only memory (ROM) and a Random access memory (RAM) for storing a program and data to be used for controlling the operation of the lighting operation of the inverter fluorescent lamp 78. The reference numbers 86 to 89 denote input/output ports for outputting pulse signals to the pre-driver 73 and control data from a control panel of a user to the microcomputer 74. The reference number 82 designates data buses through which data are connected to each other and transferred between the CPU 80, the ROM 83, the RAM 84, the timer 84, and so on.

As shown in FIG. 8, a port for the pulse signal of a ½ duty generated by the timer 84 and an input/output port for data are allocated to one input/output port 741 (or one terminal) in the microcomputer 74. That is, the input/output port 741 consisting of the terminal is connected to an input/output terminal of each of various types of devices in order to supply the pulse signal having a desired frequency. Thereby, the operation of each device is controlled based on the pulse signal having the desired frequency supplied from the microcomputer 74 through the port 741.

FIG. 8 shows the lighting circuit for a fluorescent lamp as one example to control the operation of the device based on the pulse signal having a desired frequency generated by and outputted from the microcomputer 74. In this case, the pulse signal of the optimum frequency is provided from the microcomputer 74 to the pre-driver 73 through the port 741 for each of the heating operation, the discharging operation, and the lighting operation of the fluorescent lamp 78. In addition, the microcomputer 74 has the port 742 through which control signals from a remote control unit (omitted from drawings) of a user and a switch (also omitted from drawings mounted on a wall are received. Those control signals are used for on/off operation of the fluorescent lamp 78, a delaying operation of shutoff of the fluorescent lamp 78, a variable lighting control of the fluorescent lamp 78. Further, the microcomputer 74 is capable of setting a desired level of an initial pulse signal that is generated at first and outputted when the operation of the timer 81 is initiated. In addition, the microcomputer 74 is capable of setting a desired voltage level of the output signal supplied from the microcomputer 74 during the operation of the timer 81 is halted.

The control signal received through the input port 742 is transferred to the CPU 80 through one of the input/output ports 86 to 89 and the data bus 82. The CPU 80 executes a program of the frequency switching method according to the present invention in order to control the timing and the frequency of the pulse signal outputted from the timer 81 incorporated in the microcomputer 74. This program is stored in the ROM 83 or the RAM 84. For example, a lighting control program for the inverter fluorescent lamp 78 stored in the ROM 83 or the RAM 84 is executed based on the control signal transferred from a remote control device of a user.

A description will be given of the explanation of the frequency switching method by the microcomputer as the preferred embodiments 1 to 6 of the present invention with reference to FIG. 2 to FIG. 7.

Figure 2:
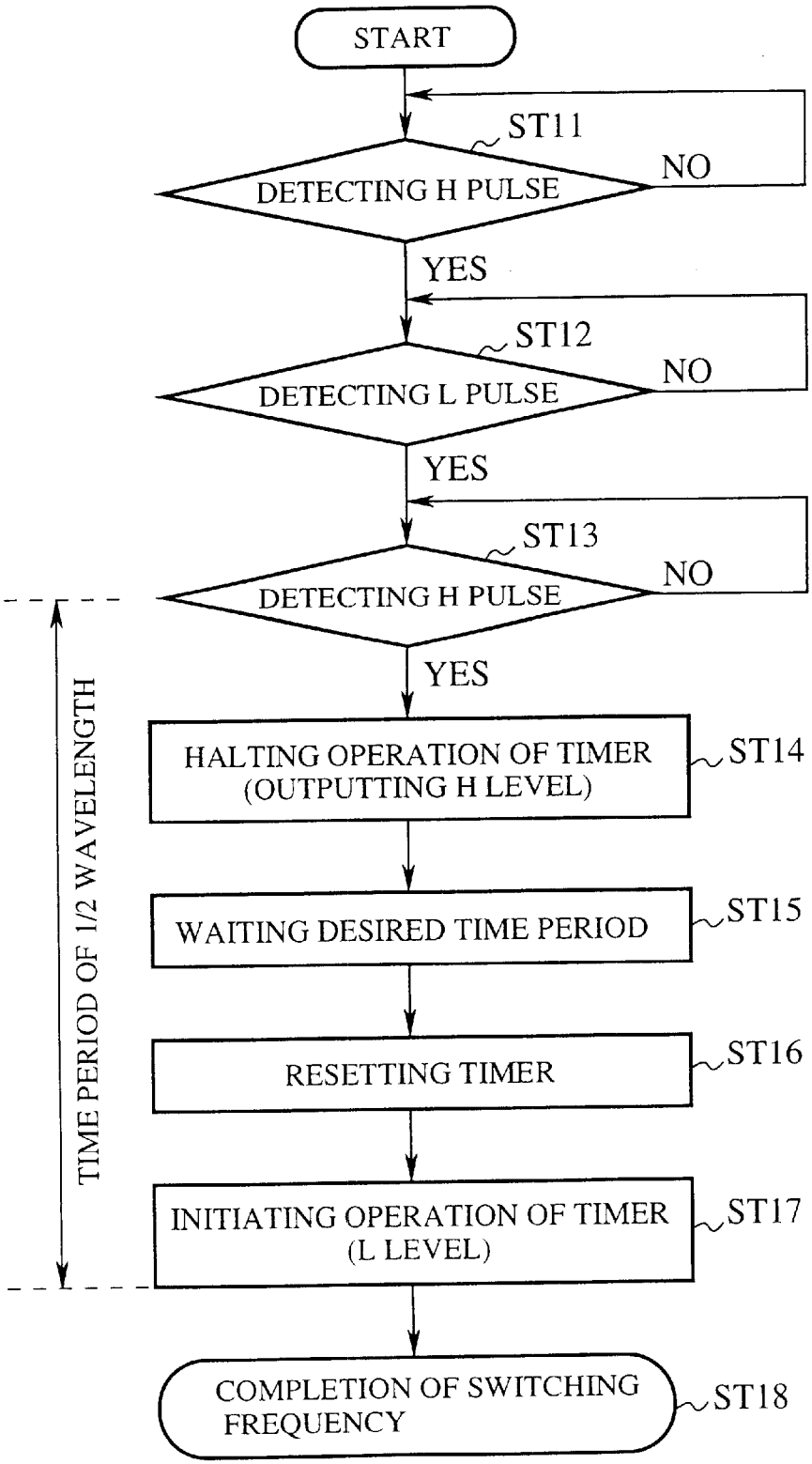
FIG. 2 is a flow chart showing the operation of a frequency switching method according to the first embodiment of the present invention.

FIG. 2 is a flowchart showing the operation of a frequency switching method according to the first embodiment of the present invention.

As described above with reference to FIG. 8, the microcomputer 74 is one of the configuration components in the frequency switching device according to the first embodiment. In the microcomputer 74, both the port outputting the pulse signal of the ½ duty generated by the timer 81 and the input/output port for signals and data are allocated to one port 741. In addition, when the operation of the timer 81 is initiated, the level of the initial pulse signal is set to a desired level. Further, while the operation of the timer 84 is halted, the level of the signal outputted through the port 741 of the microcomputer 741 can be fixed and set to a desired level.

In the pulse signal output mode of the port 741 in the microcomputer 74 in which a pulse signal generated by the timer 84 is outputted to the pre-driver 73 through the port 741, the level of the initial pulse signal (that is generated by the timer 81 at first) is set to a Low level (hereinafter referred to as a L level) when the operation of the timer 81 is initiated under the control of the CPU 80. In addition, the level of a signal outputted through the port 741 of the microcomputer 74 is set to a High level (hereinafter referred to as a H level) while the operation of the timer 84 is halted.

When the frequency of the pulse signal generated by the timer 81 is switched (or changed) to a desired frequency under the control of the CPU 80, firstly, the CPU 80 detects continuously the levels of the pulse signals that are generated and outputted by the timer 81 with a predetermined timing. When the detection results indicate that the levels of the pulse signals are the H level (Step ST11), the L level (Step ST12), and the H level (Step ST13), in order, the operation flows a following step.

When the detection results of the pulse signals are the H level, the L level, and the H level, in order, the operation of the timer 81 is halted (Step ST14) under the control of the CPU 80 during the time period of a ½ wavelength of the pulse signal counted from the detection time of the last H level (Step ST13). The timer value of the timer 81 is reset in order to switch the frequency of the pulse signal to the desired frequency (Step ST16). The operation of the timer 81 is initiated again, namely re-started (Step ST17). In this case, the signal of the H level is continuously outputted from the microcomputer 74 through the port 741 from the time at which the operation of the timer 81 is halted (Step ST14) to the time at which the operation of the timer 81 is initiated again (Step ST17).

Further, the microcomputer 74 executes a waiting instruction required-times (Step St15) in order to satisfy the condition in which the total sum of following time periods (1) to (3) becomes equal to the ½ wavelength of the pulse signal:

(1) The time period counted from the detection time (Step ST13) of the last H level of the pulse signal to the time at which the operation of the timer 81 is halted (Step ST14);

(2) The time period counted from the time at which the operation of the timer 81 is halted (Step ST14) to the reset time of the timer value of the timer 81 (Step ST16); and (3) The time period counted from the reset time of the timer value of the timer 81 (Step ST16) to the restart time of the operation of the timer 81 (Step ST17).

Then, the operation of the timer 81 is restarted (Step ST17) after the passage of the time of the ½ wavelength of the pulse signal counted from the detection time (Step ST13) of the last H level of the pulse signal.

In this situation, the timer 81 outputs the pulse signals continuously in which the level of the initial pulse signal having the desired and switched frequency is the L level. Thereby, the switching operation of the frequency of the pulse signal from the timer 81 is completed (Step ST18).

As described above, under the control of the program to be executed by the CPU 80 in the microcomputer 74 according to the first embodiment of the present invention, it is firstly detected that the levels of the pulse signals generated by the timer 81 are the H level, the L level, and the H level, in order. Then, during the time period of the ½ wavelength of the pulse signal counted from the time at which the last H level of the pulse signal is detected, the operation of the timer 81 is halted and the signal of the H level is outputted simultaneously through the port 741 of the microcomputer 74, and a new timer value is set to the timer 84 in order to output the pulse signal of a desired frequency. The operation of the timer 84 is then initiated at the time that the period of the ½ wavelength of the pulse signal is just passed. Thus, the pulse signal of the desired frequency is supplied to the pre-driver 73 continuously. Accordingly, when comparing with the conventional one, the frequency switching method and the device of the present invention is capable of preventing the generation and output of any abnormal pulse signal having a very small pulse width when the frequency of the pulse signal is switched. In addition to this feature, even if the microcomputer do not have a timer that is not capable of switching a current timer value to a new timer value when the timer value is switched during the operation of the timer, it is possible to switch and supply the pulse signal of the ½ duty having the desired frequency without giving any damage to devices. In addition, it is acceptable to use one of both the pulse signals before and after the switching of the frequency as the pulse signal having the ½ wavelength described above.

Second Embodiment

Figure 3:
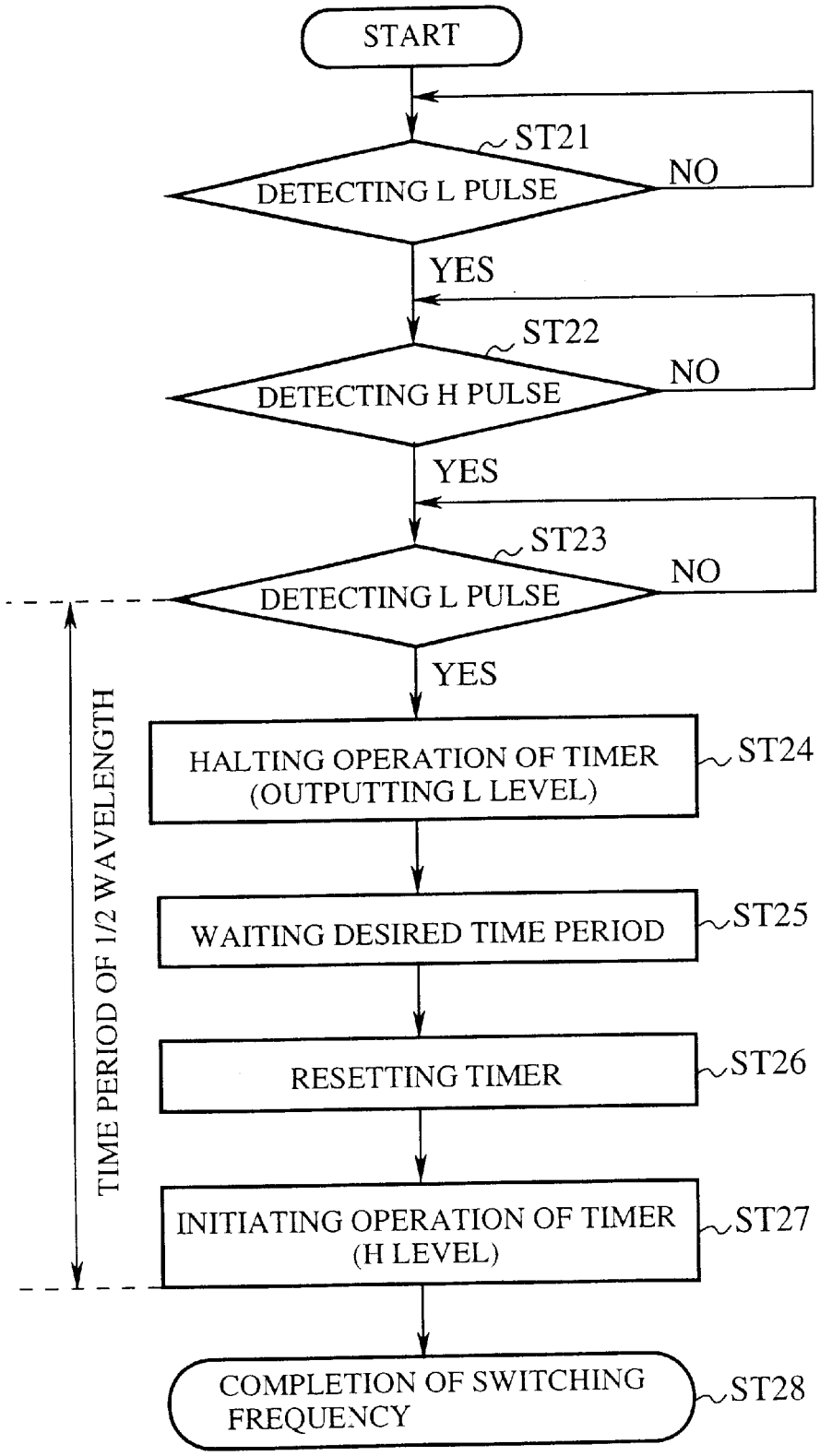
FIG. 3 is a flow chart showing the operation of a frequency switching method according to the second embodiment of the present invention.

FIG. 3 is a flow chart showing the operation of the frequency switching method according to the second embodiment of the present invention. As described above with reference to FIG. 8, the microcomputer 74 as one of the configuration components of the frequency switching device performs the frequency switching method according to the second embodiment. In the microcomputer 74, both the port outputting the pulse signal of the ½ duty generated by the timer 81 and the input/output port of data are allocated to one port 741. In addition, the level of the initial pulse signal when the operation of the timer 81 is initiated can be set to a desired level. Further, the level of the signal outputted through the port 741 can be fixed and set to a desired level while the operation of the timer 84 is halted. Because the configuration of the frequency switching device performing the frequency switching method of the second embodiment is the same of that of the first embodiment shown in FIG. 8 and FIG. 9, the same reference numbers are used and therefore the explanation of them is omitted here.

A description will be given of the explanation of the frequency switching method of the second embodiment.

In the pulse signal output mode of the port 741 in the microcomputer 74, a pulse signal generated by the timer 84 is outputted to the pre-driver 73 through the port 741. In this pulse signal output mode of the port 741, the level of the initial pulse signal (that is generated by the timer 81 at first) is set to the H level when the operation of the timer 81 is initiated under the control of the CPU 80. In addition, the level of a signal outputted through the port 741 in the microcomputer 74 is set to the L level while the operation of the timer 84 is halted.

When the frequency of the pulse signal generated by the timer 81 is switched (or changed) to a desired frequency under the control of the CPU 80, at first, the CPU 80 detects continuously the levels of the pulse signals that are generated and outputted by the timer 81 with a predetermined timing. When the detection results indicate that the levels of the pulse signals are the L level (Step ST21), H level (Step ST22), and the L level (Step ST23), in order, the operation flows a following step.

When the detection results of the pulse signals are the L level, the H level, and the L level, in order, the operation of the timer 81 is halted (Step ST24) under the control of the CPU 80 during the time period of the ½ wavelength of the pulse signal counted from the detection time (Step ST23) of the last L level. The timer value of the timer 81 is reset in order to switch the frequency of the pulse signal to the desired frequency (Step ST26). The operation of the timer 81 is then initiated again, namely, re-started (Step ST27). In this case above, the signal of the L level is continuously outputted from the microcomputer 74 through the port 741 from the time at which the operation of the timer 81 is halted (Step ST24) to the time at which the operation of the timer 81 is initiated again (Step ST27).

Further, the microcomputer 74 executes a waiting instruction required-times (Step St25) in order to satisfy the condition in which the total sum of following time periods (4) to (6) becomes equal to the ½ wavelength of the pulse signal:

(4) The time period counted from the detection time (Step ST23) of the last L level of the pulse signal to the time at which the operation of the timer 81 is halted (Step ST24);

(5) The time period counted from the time at which the operation of the timer 81 is halted (Step ST24) to the reset time (Step ST26) of the timer value of the timer 81; and (6) The time period counted from the reset time (Step ST26) of the timer value of the timer 81 to the restart time (Step ST27) of the operation of the timer 81.

Then, the operation of the timer 81 is restarted (Step ST27) after the passage of the time of the ½ wavelength of the pulse signal counted from the detection time (Step ST23) of the last L level of the pulse signal. In this situation, the timer 81 continuously outputs the pulse signals in which the level of the initial pulse signal having the desired and switched frequency is the H level. Thereby, the switching operation of the frequency of the pulse signal from the timer 81 is completed (Step ST28).

As described above, under the control of the program executed by the CPU 80 in the microcomputer 74 according to the second embodiment of the present invention, it is firstly detected that the levels of the pulse signals generated by the timer 81 are the L level, the H level, and the L level, in order. During the time period of the ½ wavelength of the pulse signal counted from the time at which the last L level of the pulse signal is detected, the operation of the timer 81 is halted and the signal of the L level is simultaneously outputted through the port 741 of the microcomputer 74, and a new timer value is set to the timer 84 in order to output the pulse signal of a desired frequency. Then, the operation of the timer 84 is initiated at the time that the period of the ½ wavelength of the pulse signal is passed. Thus, the pulse signal of the desired frequency is supplied to the pre-driver 73 continuously. Accordingly, when comparing with the conventional one, the frequency switching method and the frequency switching device of the present invention is capable of preventing the generation and output of any abnormal pulse signal having a very small pulse width when the frequency of the pulse signal is switched. In addition to this feature, even if the microcomputer do not have a timer that is not capable of switching a current timer value to a new timer value when the timer value is switched during the operation of the timer, it is possible to switch and supply the pulse signal of the ½ duty having the desired frequency without giving any damage to devices. In addition, it is acceptable to use one of both the pulse signals before and after the switching of the frequency as the pulse signal having the ½ wavelength described above.

Third Embodiment

Figure 4:
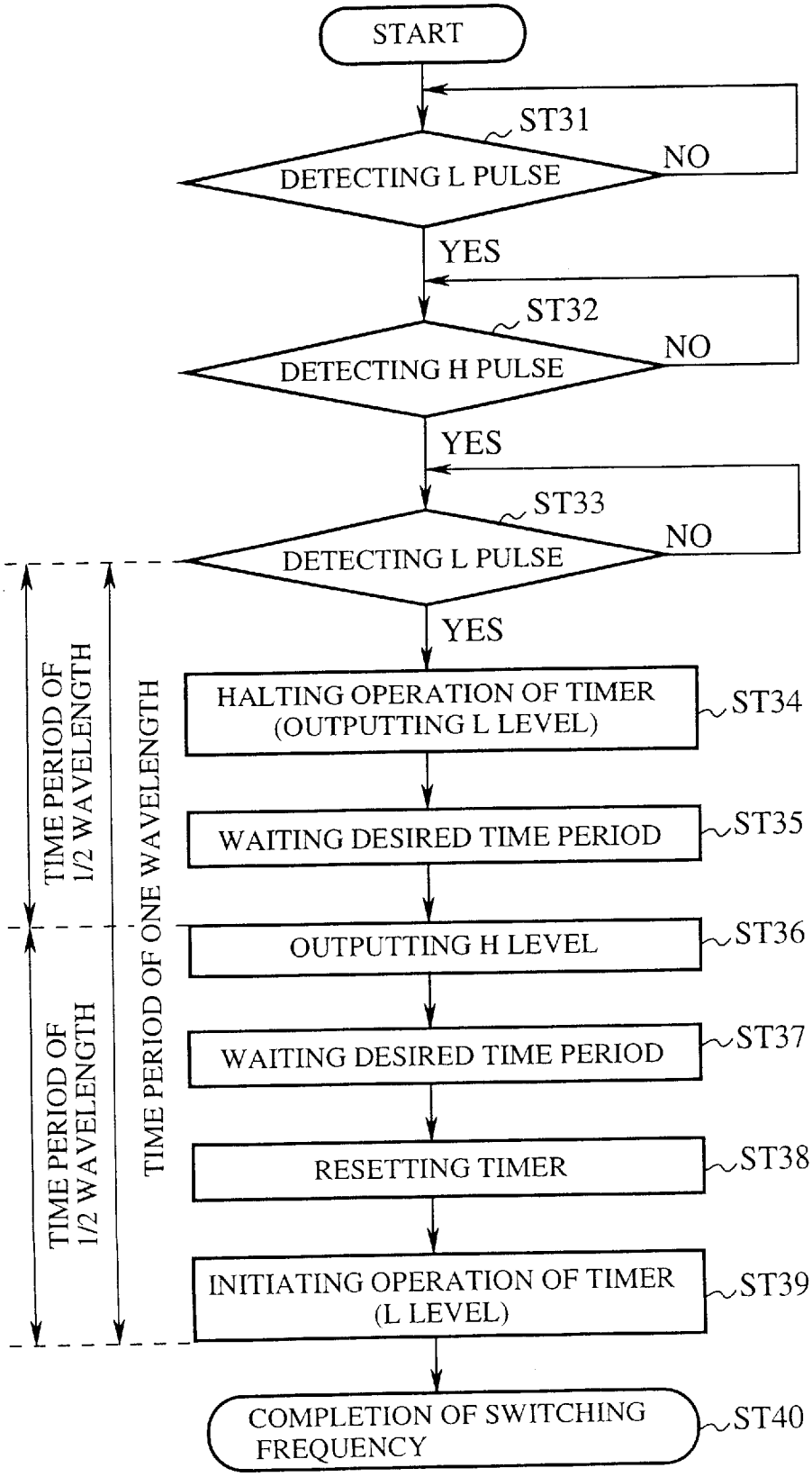
FIG. 4 is a flow chart showing the operation of a frequency switching method according to the third embodiment of the present invention.

FIG. 4 is a flow chart showing the operation of the frequency switching method according to the third embodiment of the present invention. As described above with reference to FIG. 8, the microcomputer 74 as one of the configuration components of the frequency switching device performs the frequency switching method according to the third embodiment. In the microcomputer 74, both the port outputting the pulse signal of the ½ duty generated by the timer 81 and the input/output port of data are allocated to one port 741. In addition, the level of the initial pulse signal can be set to a desired level when the operation of the timer 81 is initiated. Further, while the operation of the timer 84 is halted, the level of the signal outputted through the port 741 can be fixed and set to a desired level. Because the configuration of the frequency switching device performing the frequency switching method of the third embodiment is the same of that of the first embodiment shown in FIG. 8 and FIG. 9, the same reference numbers are used and therefore the explanation of them is omitted here.

A description will be given of the explanation of the frequency switching method of the third embodiment.

In the pulse signal output mode of the port 741 in the microcomputer 74, pulse signals generated by the timer 84 are outputted to the pre-driver 73 through the port 741. In the pulse signal output mode of the port 741, the level of the initial pulse signal (that is generated by the timer 81 at first) is set to the L level when the operation of the timer 81 is initiated under the control of the CPU 80. In addition, the level of a signal outputted through the port 741 of the microcomputer 74 is set to the L level while the operation of the timer 84 is halted.

When the frequency of the pulse signal generated by the timer 81 is switched (or changed) to a desired frequency under the control of the CPU 80, at first, the CPU 80 detects continuously the levels of the pulse signals that are generated and outputted by the timer 81 with a predetermined timing. When the detection results indicate that the levels of the pulse signals are the L level (Step ST31), H level (Step ST32), and the L level (Step ST33), in order, the operation flows a following step.

When the detection results of the pulse signals are the L level, the H level, and the L level, in order, the operation of the timer 81 is halted (Step ST34) under the control of the CPU 80 during the time period of one wavelength of the pulse signal counted from the detection time (Step ST33) of the last L level. The timer value of the timer 81 is reset in order to switch the frequency of the pulse signal to the desired frequency (Step ST38). The operation of the timer 81 is then initiated again or re-started (Step ST39).

In this case, the microcomputer 74 executes a waiting instruction required-times (Step St35 and Step ST37) in order to satisfy the condition in which the total sum of following time periods (7) to (9) becomes equal to one wavelength of the pulse signal:

(7) The time period counted from the detection time (Step ST33) of the last L level of the pulse signal to the time (Step ST34) at which the operation of the timer 81 is halted;

(8) The time period counted from the time (Step ST34) at which the operation of the timer 81 is halted to the reset time (Step ST38) of the timer value of the timer 81; and (9) The time period counted from the reset time (Step ST38) of the timer value of the timer 81 to the restart time (Step ST39) of the operation of the timer 81.

Then, the operation of the timer 81 is restarted (Step ST39) after the passage of the time of one wavelength of the pulse signal counted from the detection time (Step ST33) of the last L level of the pulse signal.

In addition, the microcomputer 74 outputs the signal of the L level (Step ST34) through the port 741 during the following time period: This time period is the time counted from that the timer 81 is halted (Step St34) to the time that the time of the ½ wavelength as the first half in one wavelength of the pulse signal is passed counted from the detection time of the last L level of the pulse signal (Step ST33).

Furthermore, the microcomputer 74 outputs the signal of the H level (Step ST36) through the port 741 during the following time period: This time period is the time counted from that the time of the ½ wavelength as the first half in one wavelength is passed counted from the detection time of the last L level of the pulse signal (Step ST33) to the time that the ½ wavelength as the latter half in one wavelength is passed, that is, the operation of the timer 81 is restarted (Step ST39).

After the restart of the operation of the timer 81 (Step ST39), the timer 81 outputs the pulse signals continuously in which the level of the initial pulse signal of the desired and switched frequency is the L level. Thereby, the switching operation of the frequency of the pulse signal from the timer 81 is completed (Step ST40).

In the explanation described above, the level of the signal outputted through the port 741 is the L level when the operation of the timer 81 is halted (Step ST34), and the level of the initial pulse signal is the L level when the timer 81 is restarted (Step ST39). However, the present invention is not limited by this condition, for example, it is possible to generated and output the L level of each of the signal and the pulse signal through the port 741, respectively. In this case, it is also possible to obtain the same effect, and the L level of the signal is continuously outputted through the port 741 during the time period counted from the time at which the time of the ½ wavelength is passed (counted from the detection time (Step ST33) of the last L level) to the time at which the latter half in one wavelength is passed, that is, until the timer 81 is restarted (Step ST39).

As described above, according to the third embodiment of the present invention, under the control of the program to be executed by the CPU 80 in the microcomputer 74, it is firstly detected that the levels of the pulse signals generated by the timer 81 are the L level, the H level, and the L level, in order. Then, during the time period of one wavelength of the pulse signal counted from the time at which the last L level of the pulse signal is detected, the operation of the timer 81 is halted and the signal of the L level is simultaneously outputted through the port 741 of the microcomputer 74 (during the time of the first half in one wavelength), and a new timer value is set to the timer 84 in order to output the pulse signal of a desired frequency. Then, the signal of the H level is outputted through the port 741 of the microcomputer 74 during the time of the latter half in one wavelength, namely, until the time at which the timer 81 is restarted. Further, the operation of the timer 84 is restarted at the time that the time period of one wavelength of the pulse signal is passed. Thus, the pulse signal of the desired frequency is continuously supplied to the pre-driver 73. Accordingly, when comparing with the conventional one, the frequency switching method and the device of the present invention is capable of preventing generation and output of any abnormal pulse signal having a very small pulse width when the frequency of the pulse signal is switched. In addition to this feature, even if the microcomputer do not have a timer that is not capable of switching a current timer value to a new timer value when the timer value is switched during the operation of the timer, it is possible to switch and supply the pulse signal of the ½ duty having the desired frequency without giving any damage to devices. In addition, it is acceptable to use one of both the pulse signals before and after the switching of the frequency as the pulse signal of one wavelength described above.

Fourth Embodiment

Figure 5:
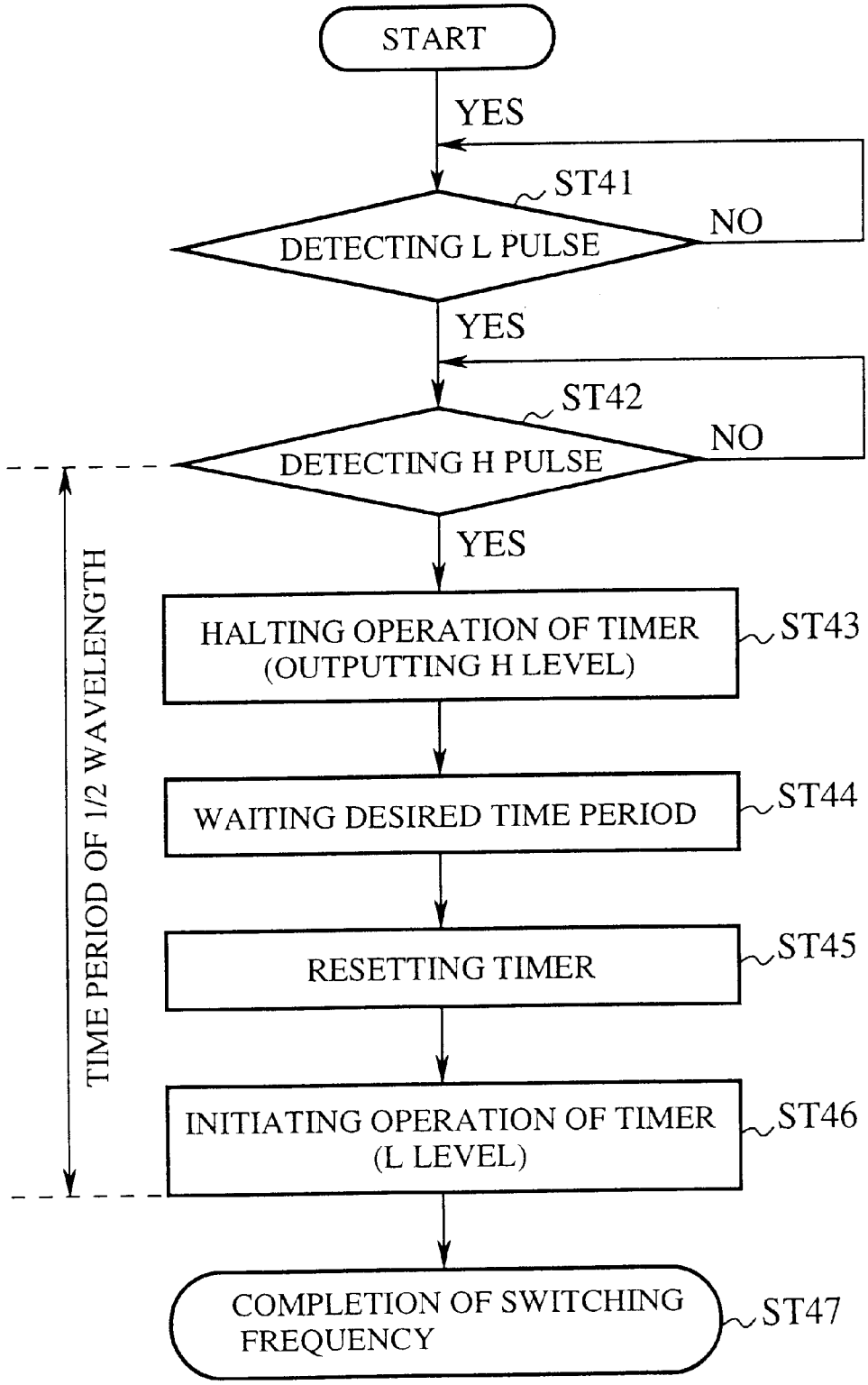
FIG. 5 is a flow chart showing the operation of a frequency switching method according to the fourth embodiment of the present invention.

FIG. 5 is a flow chart showing the operation of a frequency switching method according to the fourth embodiment of the present invention. As shown in FIG. 8, the microcomputer 74 as one of the configuration components of the frequency switching device performs the frequency switching method according to the fourth embodiment of the present invention. In the microcomputer 74, both the port outputting the pulse signal of the ½ duty generated by the timer 81 and the input/output port of data are allocated to one port 741. In addition, when the operation of the timer 81 is initiated, the level of the initial pulse signal is set to a desired level. Further, the level of the signal outputted through the port 741 of the microcomputer 741 can be fixed and set to a desired level while the operation of the timer 84 is halted. Because the configuration of the frequency switching device performing the frequency switching method of the fourth embodiment is the same of that of the first embodiment shown in FIG. 8 and FIG. 9, the same reference numbers are used and therefore the explanation of them is omitted here.

A description will be given of the explanation of the frequency switching method of the fourth embodiment.

In the pulse signal output mode of the port 741 in the microcomputer 74, a pulse signal generated by the timer 84 is outputted to the pre-driver 73 through the port 741. In the pulse signal output mode of the port 741, the level of the initial pulse signal (that is generated by the timer 81 at first) is set to the L level when the operation of the timer 81 is initiated under the control of the CPU 80. In addition, the level of a signal outputted through the port 741 of the microcomputer 74 is set to the H level while the operation of the timer 84 is halted.

When the frequency of the pulse signal generated by the timer 81 is switched (or changed) to a desired frequency under the control of the CPU 80, at first, the CPU 80 detects continuously the levels of the pulse signals that are generated and outputted by the timer 81 with a predetermined timing. When the detection results indicate that the levels of the pulse signals are the L level (Step ST41) and the H level (Step ST42), in order, the operation flows a following step.

When the detection results of the pulse signals are the L level and the H level, in order, the operation of the timer 81 is halted (Step ST14) under the control of the CPU 80 during the time period of the ½ wavelength of the pulse signal counted from the detection time (Step ST13) of the last H level. The timer value of the timer 81 is reset in order to switch the frequency of the pulse signal to the desired frequency (Step ST45). The operation of the timer 81 is initiated again, namely, re-started (Step ST46). In this case, the signal of the H level is continuously outputted from the microcomputer 74 through the port 741 from the time at which the operation of the timer 81 is halted (Step ST43) to the time at which the operation of the timer 81 is initiated again (Step ST46). Further, the microcomputer 74 executes a waiting instruction required-times (Step St44) in order to satisfy the condition in which the total sum of following time periods (10) to (12) becomes equal to the ½ wavelength of the pulse signal:

(10) The time period counted from the detection time of the last H level of the pulse signal (Step ST42) to the time at which the operation of the timer 81 is halted (Step ST43);

(11) The time period counted from the time at which the operation of the timer 81 is halted (Step ST43) to the reset time of the timer value of the timer 81 (Step ST45); and

(12) The time period counted from the reset time of the timer value of the timer 81 (Step ST45) to the restart time of the operation of the timer 81 (Step ST46).

Then, the operation of the timer 81 is restarted (Step ST46) after the passage of the time of the ½ wavelength of the pulse signal counted from the detection time (Step ST42) of the last H level of the pulse signal. In this situation, the timer 81 continuously outputs the pulse signals in which the level of the initial pulse signal having the desired and switched frequency is the L level. Thereby, the switching operation of the frequency of the pulse signal from the timer 81 is completed (Step ST47).

As described above, under the control of the program executed by the CPU 80 in the microcomputer 74 according to the fourth embodiment of the present invention, it is firstly detected that the levels of the pulse signals generated by the timer 81 are the L level and the H level, in order. Then, during the time period of the ½ wavelength of the pulse signal counted from the time at which the last H level of the pulse signal is detected, the operation of the timer 81 is halted and the signal of the H level is simultaneously outputted through the port 741 of the microcomputer 74, and a new timer value is set to the timer 84 in order to output the pulse signal of a desired frequency. Then, the operation of the timer 84 is initiated at the time that the period of the ½ wavelength of the pulse signal is passed. Thus, the pulse signal of the desired frequency is supplied to the pre-driver 73 continuously. Accordingly, when comparing with the conventional one, the frequency switching method and the device of the present invention is capable of preventing generation and output of any abnormal pulse signal having a very small pulse width when the frequency of the pulse signal is switched. In addition to this feature, even if the microcomputer do not have a timer that is not capable of switching a current timer value to a new timer value when the timer value is switched during the operation of the timer, it is possible to switch and supply the pulse signal of the ½ duty having the desired frequency without giving any damage to devices. In addition, it is acceptable to use one of both the pulse signals before and after the switching of the frequency as the pulse signal having the ½ wavelength described above.

Fifth Embodiment

Figure 6:
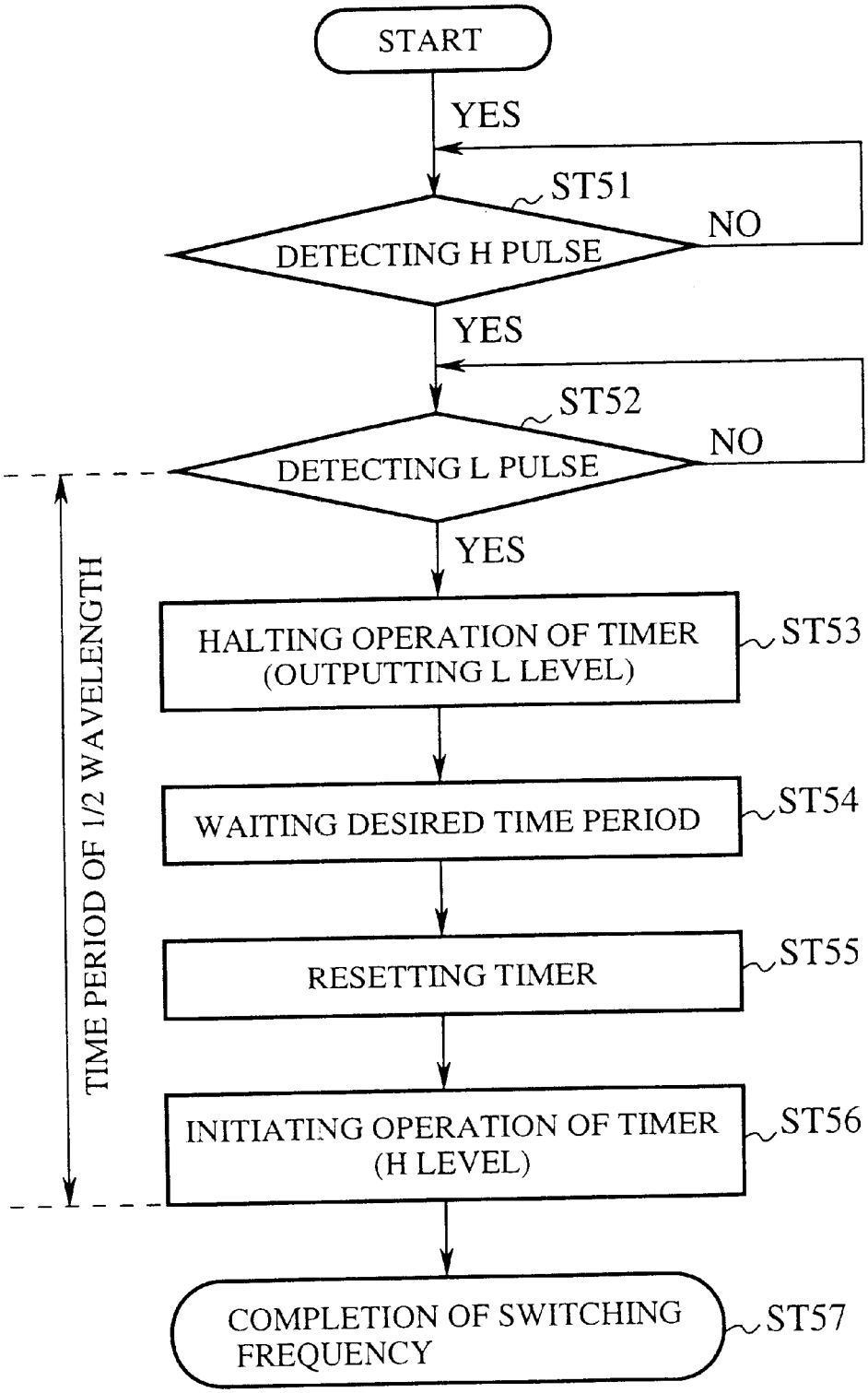
FIG. 6 is a flowchart showing the operation of a frequency switching method according to the fifth embodiment of the present invention.

FIG. 6 is a flow chart showing the operation of a frequency switching method according to the fifth embodiment of the present invention. As described above with reference to FIG. 8, the microcomputer 74 as one of the configuration components of the frequency switching device performs the frequency switching method according to the fifth embodiment of the present invention. In the microcomputer 74, both the port outputting the pulse signal of the ½ duty generated by the timer 81 and the input/output port of data are allocated to one port 741. In addition, the level of the initial pulse signal when the operation of the timer 81 is initiated can be set to a desired level. Further, the level of the signal outputted through the port 741 can be fixed and set to a desired level while the operation of the timer 84 is halted. Because the configuration of the frequency switching device performing the frequency switching method of the fifth embodiment is the same of that of the first embodiment shown in FIG. 8 and FIG. 9, the same reference numbers are used and therefore the explanation of them is omitted here.

A description will be given of the explanation of the frequency switching method of the fifth embodiment.

In the pulse signal output mode of the port 741 in the microcomputer 74 in which a pulse signal generated by the timer 84 is outputted to the pre-driver 73 through the port 741, the level of the initial pulse signal (that is generated by the timer 81 at first) is set to the H level when the operation of the timer 81 is initiated under the control of the CPU 80. In addition, the level of a signal outputted through the port 741 of the microcomputer 74 is set to the L level while the operation of the timer 84 is halted.

When the frequency of the pulse signal generated-by the timer 81 is switched or changed to a desired frequency under the control of the CPU 80, at first, the CPU 80 detects continuously the levels of the pulse signals that are generated and outputted by the timer 81 with a predetermined timing. When the detection results indicate that the levels of the pulse signals are the H level (Step ST51) and the L level (Step ST52), in order, the operation flows a following step.

When the detection results of the pulse signals are the H level and the L level, in order, the operation of the timer 81 is halted (step ST53) under the control of the CPU 80 during the time period of the ½ wavelength of the pulse signal counted from the detection time (Step ST52) of the last L level. The timer value of the timer 81 is reset in order to switch the frequency of the pulse signal to the desired frequency (Step ST55). The operation of the timer 81 is then initiated again, namely, re-started (Step ST56). In this case, the signal of the L level is continuously outputted from the microcomputer 74 through the port 741 from the time at which the operation of the timer 81 is halted (Step ST53) to the time at which the operation of the timer 81 is initiated again (Step ST56).

Further, the microcomputer 74 executes a waiting instruction required-times (Step St54) in order to satisfy the condition in which the total sum of following time periods (13) to (15) becomes equal to the ½ wavelength of the pulse signal:

(13) The time period counted from the detection time (Step ST52) of the last L level of the pulse signal to the time at which the operation of the timer 81 is halted (Step ST53);

(14) The time period counted from the time at which the operation of the timer 81 is halted (Step ST53) to the reset time of the timer value of the timer 81 (Step ST55); and

(15) The time period counted from the reset time (Step ST55) of the timer value of the timer 81 to the restart time (Step ST56) of the operation of the timer 81.

Then, the operation of the timer 81 is restarted (Step ST56) after the passage of the time of the ½ wavelength of the pulse signal counted from the detection time (Step ST52) of the last L level of the pulse signal. In this situation, the timer 81 continuously outputs the pulse signals in which the level of the initial pulse signal having the desired and switched frequency is the H level. Thereby, the switching operation of the frequency of the pulse signal from the timer 81 is completed (Step ST57).

As described above, under the control of the program executed by the CPU 80 in the microcomputer 74 according to the fifth embodiment of the present invention, it is firstly detected that the levels of the pulse signals generated by the timer 81 are the H level and the L level, in order. Then, during the time period of the ½ wavelength of the pulse signal counted from the time at which the last L level of the pulse signal is detected, the operation of the timer 81 is halted and the signal of the L level is simultaneously outputted through the port 741 of the microcomputer 74, and a new timer value is set to the timer 84 in order to output the pulse signal of a desired frequency. Then, the operation of the timer 84 is initiated at the time that the period of the ½ wavelength of the pulse signal is passed. Thus, the pulse signal of the desired frequency is supplied to the pre-driver 73 continuously. Accordingly, when comparing with the conventional one, the frequency switching method and the device of the present invention is capable of preventing generation and output of any abnormal pulse signal having a very small pulse width when the frequency of the pulse signal is switched. In addition to this feature, even if the microcomputer do not have a timer that is not capable of switching a current timer value to a new timer value when the timer value is switched during the operation of the timer, it is possible to switch and supply the pulse signal of the ½ duty having the desired frequency without giving any damage to devices. In addition, it is acceptable to use one of both the pulse signals before and after the switching of the frequency as the pulse signal having the ½ wavelength described above.

Sixth Embodiment

Figure 7:
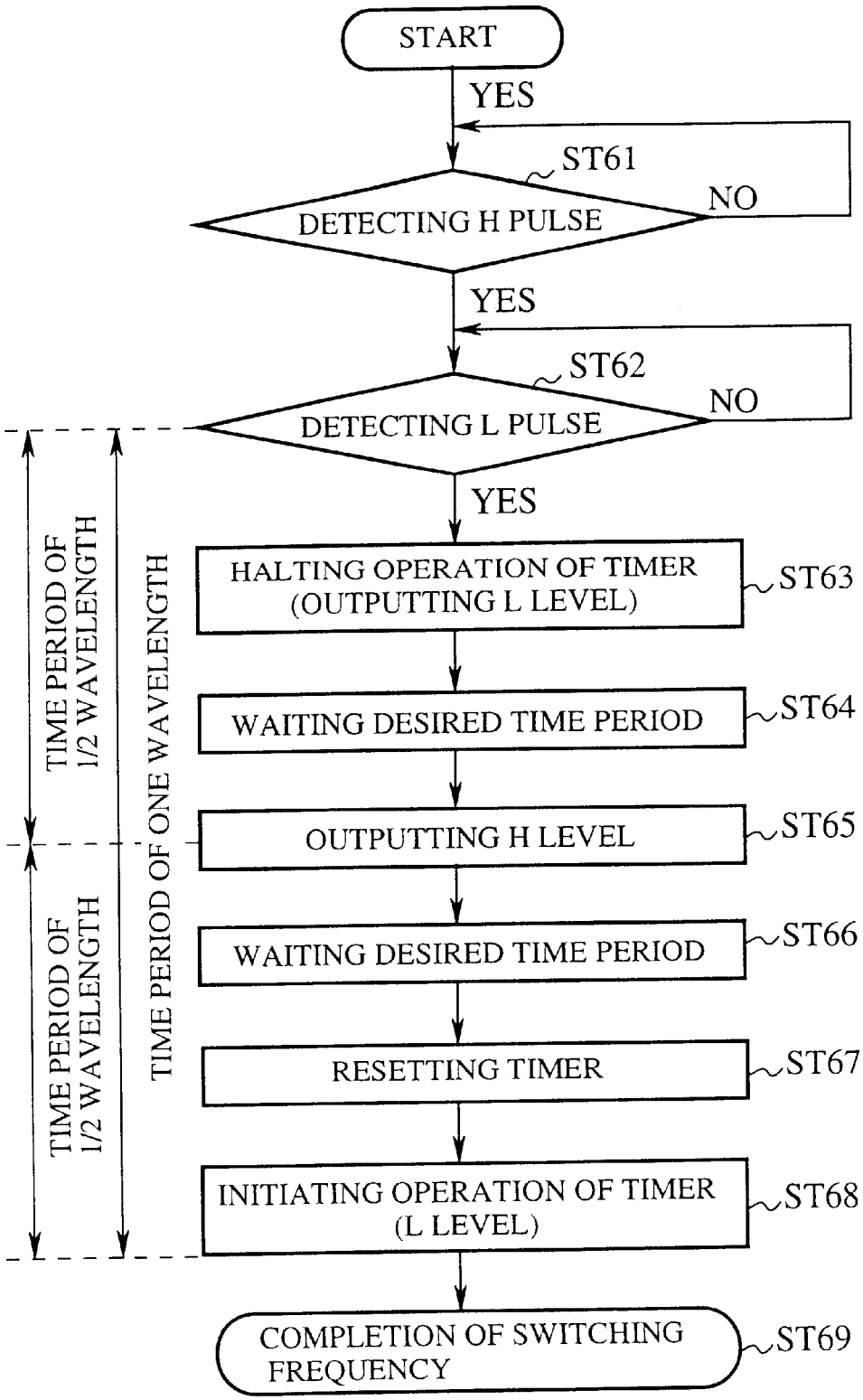
FIG. 7 is a flow chart showing the operation of a frequency switching method according to the sixth embodiment of the present invention.

FIG. 7 is a flowchart showing the operation of a frequency switching method according to the sixth embodiment of the present invention. As described above with reference to FIG. 8, the microcomputer 74 as one of the configuration components of the frequency switching device performs the frequency switching method according to the sixth embodiment of the present invention. In the microcomputer 74, both the port outputting the pulse signal of the ½ duty generated by the timer 81 and the input/output port of data are allocated to one port 741. In addition, the level of the initial pulse signal when the operation of the timer 81 is initiated can be set to a desired level. Further, the level of the signal outputted through the port 741 can be fixed and set to a desired level while the operation of the timer 84 is halted. Because the configuration of the frequency switching device performing the frequency switching method of the sixth embodiment is the same of that of the first embodiment shown in FIG. 8 and FIG. 9, the same reference numbers are used and therefore the explanation of them is omitted here.

A description will be given of the explanation of the frequency switching method of the sixth embodiment.

In the pulse signal output mode of the port 741 of the microcomputer 74, a pulse signal generated by the timer 84 is outputted to the pre-driver 73 through the port 741. In the pulse signal output mode of the port 741, the level of the initial pulse signal (that is generated by the timer 81 at first) is set to the L level when the operation of the timer 81 is initiated under the control of the CPU 80. In addition, the level of a signal outputted through the port 741 in the microcomputer 74 is set to the L level while the operation of the timer 84 is halted.

When the frequency of the pulse signal generated by the timer 81 is switched (or changed) to a desired frequency under the control of the CPU 80, at first, the CPU 80 detects continuously the levels of the pulse signals that are generated and outputted by the timer 81 with a predetermined timing. When the detection results indicate that the levels of the pulse signals are the H level (Step ST61) and the L level (Step ST62), in order, the operation flows a following step.

When the detection results of the pulse signals are the H level and the L level, in order, the operation of the timer 81 is halted (Step ST63) under the control of the CPU 80 during the time period of one wavelength of the pulse signal counted from the detection time (Step ST62) of the last L level. The timer value of the timer 81 is reset in order to switch the frequency of the pulse signal to the desired frequency (Step ST67). The operation of the timer 81 is then initiated again or re-started (Step ST68).

In this case, the microcomputer 74 executes a waiting instruction required-times (Step ST64 and Step ST66) in order to satisfy the condition in which the total sum of following time periods (13) to (15) becomes equal to one wavelength of the pulse signal:

(13) The time period counted from the detection time (Step ST62) of the last L level of the pulse signal to the time at which the operation of the timer 81 is halted (Step ST63);

(14) The time period counted from the time at which the operation of the timer 81 is halted (Step ST63) to the reset time (Step ST67) of the timer value of the timer 81; and

(15) The time period counted from the reset time (Step ST67) of the timer value of the timer 81 to the restart time (Step ST68) of the operation of the timer 81.

In this case, the signal of the L level is continuously outputted from the microcomputer 74 through the port 741 from the time at which the operation of the timer 81 is halted (Step ST63) to the time at which the time of the ½ wavelength as the first half in one wavelength (counted from the detection time (Step ST62) of the last L level of the pulse signal) is passed.

In addition, the microcomputer 74 outputs the signal of the H level (Step ST65) through the port 741 during the following time period: This time period is from the time at which the time of the ½ wavelength of the pulse signal is passed counted from the detection time (Step ST62) of the last L level of the pulse signal to the time of the ½ wavelength as the latter half in one wavelength is passed. That is, to the time that the operation of the timer 81 is restarted (Step ST68).

After the restart of the operation of the timer 81 (Step ST68), the timer 81 continuously outputs the pulse signals in which the level of the initial pulse signal having the desired (switched) frequency is the L level. Thereby, the switching operation of the frequency of the pulse signal from the timer 81 is completed (Step ST69).

In the explanation described above, the level of the signal is the L level through the port 741 when the operation of the timer 81 is halted (Step ST63), and the level of the initial pulse signal is the L level when the timer 81 is restarted (Step ST68). However, the present invention is not limited by this condition, for example, it is possible to generated and output the H level of each of the signal and the pulse signal through the port 741, respectively. In this case, it is also possible to obtain the same effect, and the L level of the signal is continuously outputted through the port 741 during the time period counted from the time at which the time of the ½ wavelength is passed (counted from the detection time (Step ST62) of the last L level) to the time at which the latter half in one wavelength is passed, that is, until the restart of the timer 81 (Step ST68).

As described above, under the control of the program executed by the CPU 80 in the microcomputer 74 according to the sixth embodiment of the present invention, it is firstly detected that the levels of the pulse signals generated by the timer 81 are the H level and the L level, in order. Then, during the time period of one wavelength of the pulse signal counted from the time at which the last L level of the pulse signal is detected, the operation of the timer 81 is halted and the signal of the L level is simultaneously outputted through the port 741 in the microcomputer 74 (during the time of the ½ wavelength as the first half in one wavelength), and a new timer value is set to the timer 84 in order to output the pulse signal of a desired frequency. In this case, the signal of the H level is outputted through the port 741 of the microcomputer 74 during the time of the ½ wavelength as the latter half in one wavelength, namely, until the time at which the timer 81 is restarted. Further, the operation of the timer 84 is restarted at the time that the time period of one wavelength of the pulse signal is just passed. Thus, the pulse signal of the desired frequency is continuously supplied to the pre-driver 73. Accordingly, when comparing with the conventional one, the frequency switching method and the device of the present invention is capable of preventing generation and output of any abnormal pulse signal having a very small pulse width when the frequency of the pulse signal is switched. In addition to this feature, even if the microcomputer do not have a timer that is not capable of switching a current timer value to a new timer value when the timer value is switched during the operation of the timer, it is possible to switch and supply the pulse signal of the ½ duty having the desired frequency without giving any damage to devices. In addition, it is acceptable to use one of both the pulse signals before and after the switching of the frequency as the pulse signal in order to count one wavelength described above.

As described above in detail, in the frequency switching method to be executed by the microcomputer according to the present invention, signal levels of pulse signals continuously generated by and outputted from a timer incorporated in the microcomputer are detected required times. When the detection results are matched with a predetermined pattern, the operation of the timer is halted and a new timer value is set to the timer during the time period of a ½ wavelength of the pulse signal counted from the time of the agreement of the detected pattern with the predetermined pattern. In addition, the timer is restarted at the time when the time of the ½ wavelength is passed in order to output the pulse signals of a required frequency. Or, the signal levels of the pulse signals continuously generated by and outputted from the timer incorporated in the microcomputer are detected required times. When the detection results are matched with a predetermined pattern, the operation of the timer is halted during the time of a first half in one wavelength of the pulse signal. Then, a new timer value is set to the timer. The timer is restarted in order to continuously output the pulse signal of a desired frequency to a driver such as the pre-driver when the time period of one wavelength of the pulse signal is just passed. In addition, the level of the first pulse signal can be set to a desired level when the operation of the timer is restarted. Accordingly, the frequency switching method and the frequency switching device of the present invention is capable of preventing the generation and output of any abnormal pulse signal having a small pulse width when the frequency of the pulse signal is changed even if microcomputers having following characteristics are used: The level of a signal to be outputted externally is fixed while the operation of the timer is halted; and the level of a first pulse signal is set a desired level and outputted when the operation of the timer is restarted. Thereby, the operation of the target devices can be controlled without giving any damage to a switching device as the driver made up of a MOS FET etc. In addition, even if there are both cases that it is permitted to expand the width of the pulse signal to be supplied or it is not permitted, the frequency switching method and device of the present invention can generate pulse signals having a desired waveform.

In addition, according to the present invention, the frequency switching device comprises a driver and a microcomputer having a memory circuit, a timer, and input/output ports. The memory circuit is a RAM or a ROM for storing a control program and control data to be used for controlling target devices. The timer generates and outputs pulse signal of ½ duty of a desired frequency by switching or re-writing a timer value. The microcomputer has the input/output ports through which the control data and the pulse signals generated by the timer are transferred. The driver is connected to the input/output ports and the driver receives the pulse signals of a desired frequency transferred from the microcomputer. The microcomputer executes the control program stored in the RAM or the ROM, and thereby the frequency switching method of the present invention can be executed. Accordingly, even if a microcomputer, that resets the timer when a timer value is changed, is used, the present invention is capable of avoiding generation of a pulse signal having a small time width. This feature can avoid the damage to the driver consisting of a MOS FET. Further, even if there are both cases that it is permitted to expand the width of the pulse signal to be supplied or it is not permitted, the frequency switching device of the present invention can generate pulse signals having a desired waveform.

While the above provides a full and complete disclosure of the preferred embodiments of the present invention, various modifications, alternate constructions and equivalents may be employed without departing from the scope of the invention. Therefore the above description and illustration should not be construed as limiting the scope of the invention, which is defined by the appended claims.

What is claimed is:

1. A frequency switching method to be executed by a microcomputer, comprising the steps of:

detecting required times signal levels of pulse signals continuously generated by and outputted from a timer incorporated in said microcomputer;

halting an operation of said timer, simultaneously outputting a predetermined level of a signal from said microcomputer while the operation of said timer is halted, and setting a desired timer value to said timer within a predetermined time period counted from a detection time of a last pulse signal having a predetermined level in said detected pulse signals when said detection results of the signal levels of the pulse signals is matched to a predetermined pattern;

restarting the operation of said timer after said predetermined time period is passed, and setting a level of a first pulse signal, to be outputted firstly at the restart time of said timer, into a predetermined level; and outputting said pulse signal having the predetermined frequency to outside of said microcomputer.

2. A frequency switching method according to claim 1, wherein the agreement of the matching of said detection results of the signal levels of the pulse signals to said predetermined pattern means that said detection results indicate a H level, a L level, and a H level, in order, and said predetermined time period is a time of a ½ wavelength of said pulse signal, and the level of the signal to be outputted from said microcomputer is the H level while the operation of said timer is halted, and a level of a first pulse signal to be outputted is the L level when said timer is restarted.

3. A frequency switching method according to claim 1, wherein the agreement of the matching of said detection results of the signal levels of the pulse signals to said predetermined pattern means that said detection results indicate a L level, a H level, and a L level, in order, and said predetermined time period is a time of a ½ wavelength of said pulse signal, and the level of the signal to be outputted from said microcomputer is the L level while the operation of said timer is halted, and a level of a first pulse signal to be outputted firstly is the H level when said timer is restarted.

4. A frequency switching method according to claim 1, wherein the agreement of the matching of said detection results of the signal levels of the pulse signals to said predetermined pattern means that said detection results indicate a L level, a H level, and a L level, in order, and said predetermined time period is a time of one wavelength of said pulse signal, and the level of the signal to be outputted from said microcomputer during a first half in said one wavelength is the L level while the operation of said timer is halted, and the level of the signal to be outputted from said microcomputer during a latter half in said one wavelength is the H level while the operation of said timer is halted, and a level of a first pulse signal to be outputted firstly is the L level when said timer is restarted.

5. A frequency switching method according to claim 1, wherein the agreement of the matching of said detection results of the signal levels of the pulse signals to said predetermined pattern means that said detection results indicate a H level, a L level, and a H level, in order, and said predetermined time period is a time of one wavelength of said pulse signal, and the level of the signal to be outputted from said microcomputer during a first half in said one wavelength is the H level while the operation of said timer is halted, and the level of the signal to be outputted from said microcomputer during a latter half in said one wavelength is the L level while the operation of said timer is halted, and a level of a first pulse signal to be outputted firstly is the H level when said timer is restarted.

6. A frequency switching method according to claim 1, wherein the agreement of the matching of said detection results of the signal levels of the pulse signals to said predetermined pattern means that said detection results indicate a L level and a H level, in order, and said predetermined time period is a time of a ½ wavelength of said pulse signal, and the level of the signal to be outputted from said microcomputer is the H level while the operation of said timer is halted, and a level of a first pulse signal to be outputted is the L level when said timer is restarted.

7. A frequency switching method according to claim 1, wherein the agreement of the matching of said detection results of the signal levels of the pulse signals to said predetermined pattern means that said detection results indicate a H level and a L level, in order, and said predetermined time period is a time of a ½ wavelength of said pulse signal, and the level of the signal to be outputted from said microcomputer is the L level while the operation of said timer is halted, and a level of a first pulse signal to be outputted firstly is the H level when said timer is restarted.

8. A frequency switching method according to claim 1, wherein the agreement of the matching of said detection results of the signal levels of the pulse signals to said predetermined pattern means that said detection results indicate a H level and a L level, in order, and said predetermined time period is a time of one wavelength of said pulse signal, and the level of the signal to be outputted from said microcomputer during a first half in said one wavelength is the L level while the operation of said timer is halted, and the level of the signal to be outputted from said microcomputer during a latter half in said one wavelength is the H level while the operation of said timer is halted, and a level of a first pulse signal to be outputted firstly is the L level when said timer is restarted.

9. A frequency switching method according to claim 1, wherein the agreement of the matching of said detection results of the signal levels of the pulse signals to said predetermined pattern means that said detection results indicate a L level and a H level, in order, and said predetermined time period is a time of one wavelength of said pulse signal, and the level of the signal to be outputted from said microcomputer during a first half in said one wavelength is the H level while the operation of said timer is halted, and the level of the signal to be outputted from said microcomputer during a latter half in said one wavelength is the L level while the operation of said timer is halted, and a level of a first pulse signal to be outputted firstly is the H level when said timer is restarted.

10. A frequency switching device comprising a microcomputer and a driver circuit for controlling a device as a target of control operation, wherein said microcomputer comprises:

a memory circuit for storing a control program and control data for controlling operation of said target device;

a timer for generating and outputting pulse signals of ½ duty of a desired frequency by changing a timer value; and an input/output port through which said control data and said pulse signals are transferred to said driver circuit, wherein said driver circuit is connected to said input/output port, and said driver circuit inputs said pulse signals outputted from said microcomputer through said input/output port, and said microcomputer executes said control program capable of performing a following process:

detecting required times signal levels of pulse signals continuously generated by and outputted from said timer;

halting an operation of said timer, simultaneously outputting a predetermined level of a signal from said microcomputer while the operation of said timer is halted, and setting a desired timer value to said timer within a predetermined time period counted from a detection time of a last pulse signal having a predetermined level in said detected pulse signals when said detection results of the signal levels of the pulse signals is matched to a predetermined pattern;

restarting the operation of said timer after said predetermined time period is passed, and setting a level of a first pulse signal, to be outputted firstly at the restart time of said timer, into a predetermined level; and outputting said pulse signal having the predetermined frequency to said driver circuit for controlling said device as said target of control operation.

* * * * *